US006250900B1

(12) United States Patent
Gostomski

(10) Patent No.: US 6,250,900 B1
(45) Date of Patent: Jun. 26, 2001

(54) POSITIVE DISPLACEMENT HYDRAULIC UNIT WITH NEAR-ZERO SIDE CLEARANCE

(75) Inventor: Victor G. Gostomski, Ames, IA (US)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/439,490

(22) Filed: Nov. 15, 1999

(51) Int. Cl.[7] ..... F01C 21/00
(52) U.S. Cl. ..... 418/178; 418/171; 418/166
(58) Field of Search ..... 418/178, 171, 418/166

(56) References Cited

U.S. PATENT DOCUMENTS

| | | | | |
|---|---|---|---|---|
| 2,393,116 | | 1/1946 | Mc Culloch et al. . | |
| 2,491,678 | | 12/1949 | Mc Culloch et al. . | |
| 2,492,935 | * | 12/1949 | McCulloch et al. | 418/178 |
| 2,519,588 | | 8/1950 | Mc Culloch . | |
| 2,754,050 | * | 7/1956 | Wellington | 418/178 |
| 3,359,956 | * | 12/1967 | Bentele | 418/178 |
| 3,705,818 | * | 12/1972 | Grosseau | 418/178 |
| 3,712,767 | * | 1/1973 | Beutter | 418/178 |
| 3,918,137 | * | 11/1975 | Telang et al | 418/178 |
| 4,023,252 | | 5/1977 | Levinstein et al. . | |
| 4,466,785 | * | 8/1984 | Biswas | 418/178 |
| 4,549,862 | * | 10/1985 | Stich et al. | 418/178 |
| 4,704,332 | * | 11/1987 | Brennan et al. | 418/178 |
| 4,717,322 | * | 1/1988 | Masuda et al. | 418/178 |

FOREIGN PATENT DOCUMENTS

| | | | | |
|---|---|---|---|---|
| 2750137 | * | 7/1978 | (DE) | 418/178 |
| 3609996 | * | 10/1987 | (DE) | 418/178 |
| 62-48984 | * | 3/1987 | (JP) | 418/178 |
| 62-147075 | * | 7/1987 | (JP) | 418/178 |

* cited by examiner

*Primary Examiner*—Thomas Denion
*Assistant Examiner*—Theresa Trieu
(74) *Attorney, Agent, or Firm*—Zarley, McKee, Thomte, Voorhees & Sease

(57) ABSTRACT

A positive displacement hydraulic unit includes a housing having a chamber formed therein with a circumferential surface bounded by a pair of spaced apart end walls. A rotary element for displacing fluid rotatably mounts in the chamber. A layer of abradable coating material is positioned between an end wall of the chamber and the adjacent side wall of the rotary element so as to provide a near-zero side clearance for the rotary element and thereby high volumetric efficiency for the hydraulic unit.

11 Claims, 1 Drawing Sheet

POSITIVE DISPLACEMENT HYDRAULIC UNIT WITH NEAR-ZERO SIDE CLEARANCE

BACKGROUND OF THE INVENTION

The present invention relates to the field of hydraulics, more particularly, positive displacement hydraulic pumps and motors having gerotors, gears, or vanes.

Positive displacement pumps and motors that include gerotors, gears, or vanes have inherent volumetric losses due to the side clearances built into the mechanism. Side clearances exist between the rotary element or fluid displacing mechanism (gerotor, gear, or vane) and the axially adjacent members, usually a housing or end cap wall. The volumetric losses are a function of the side clearances to the third power. Thus, the volumetric losses are greatly affected by the side clearances. If side clearances can be minimized, volumetric efficiency greatly increases. However, manufacturing tolerances and deflection typically dictate the side clearances and limit efficiency.

Therefore, a primary objective of the present invention is the provision of a positive displacement pump or motor with improved volumetric efficiency.

Another objective of this invention is the provision of a positive displacement pump or motor having near-zero side clearance.

Another objective of this invention is the provision of a positive displacement pump or motor having a layer of abradable sacrificial coating material applied to the housing wall adjacent the rotary element, the coating wearing-in to establish a minimal side clearance and thereby high volumetric efficiency.

Another objective of this invention is the provision of a positive displacement pump or motor that is economical to produce, easy to assembly, and reliable and durable in use.

These and other objectives will be apparent from the drawings, as well as from the description and claims that follow.

SUMMARY OF THE INVENTION

The present invention relates to the field of hydraulics, more particularly, positive displacement hydraulic units, such as pumps and motors having gerotors, gears, or vanes.

The positive displacement of hydraulic unit of this invention includes a housing having a chamber formed therein with a circumferential surface bounded by a pair of spaced apart end walls. A rotary element for displacing fluid rotatably mounts in the chamber. A layer of non-metallic abradable coating material is positioned between an end wall of the chamber and the adjacent side wall of the rotary element so as to provide a near-zero side clearance for the rotary element and thereby high volumetric efficiency for the hydraulic unit.

DETAILED DESCRIPTION OF THE PREFERRED EMBODIMENT(S)

Figure 1:
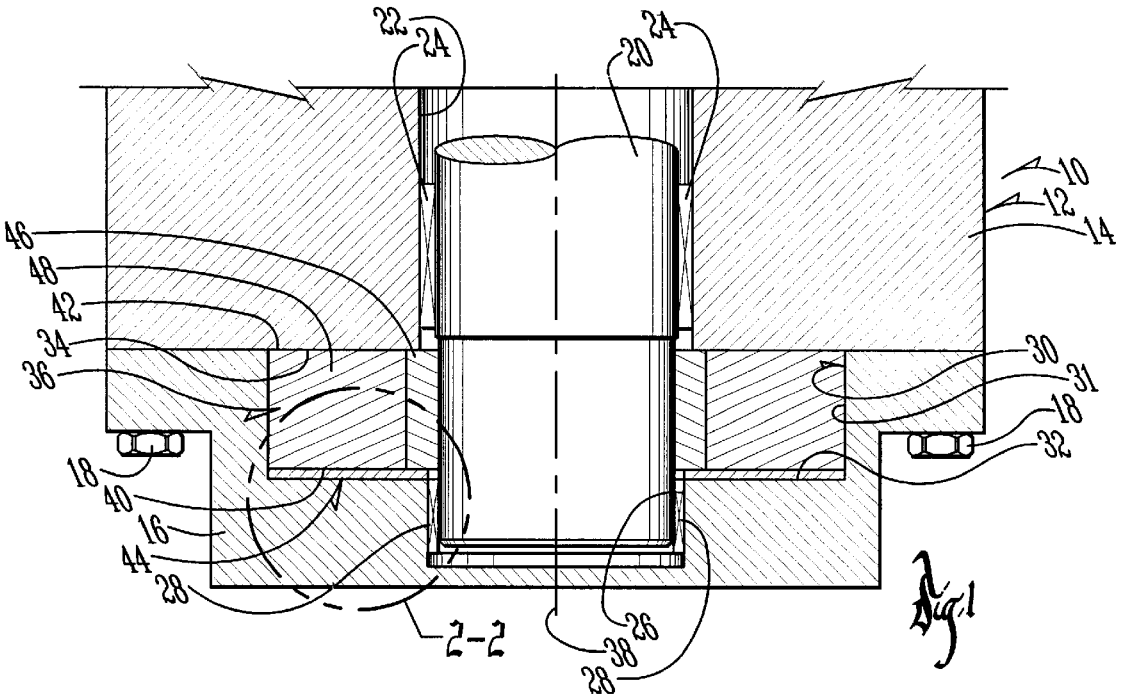
FIG. 1 is a cross-sectional view of a positive displacement hydraulic unit equipped with the present invention.

In the figures and the description that follows, the hydraulic unit of this invention is designated by the reference numeral 10. The hydraulic unit 10 has a positive fluid displacement, but can be a hydraulic pump or a hydraulic motor. As seen in FIG. 1, the hydraulic unit 10 has a housing 12 that includes a main housing body 14 and an end cap 16 detachably mounted thereto by a plurality of screws 18. A shaft 20 is rotatably mounted in bores 22, 26 with bearings 24, 28 respectively.

The housing 12 includes a cavity or a chamber 30 therein as shown. In the preferred embodiment, the chamber 30 is located in the end cap 16. However, part or all of the chamber 30 could be located in the main housing body 14 without detracting from the present invention. The chamber 30 could also be located in the main housing body 14 and merely sealed by the end cap 16. The chamber 30 has a circumferential outer surface 31 bounded by a pair of spaced apart end walls 32, 34. Preferably, the end walls 32, 34 are substantially planar and parallel to each other.

A rotary element 36 for displacing fluid is rotatably mounted along an axis of rotation 38 in the chamber 30. The rotary element 36 is secured to the shaft 20 such that the axis of rotation 38 is coincidental with the central axis of the shaft. The rotary element 36 has opposite side walls 40, 42 that are directed toward the adjacent end walls 32, 34 of the chamber 30 respectively. Preferably, the walls 32, 34, 40, 42 are substantially parallel to each other and perpendicular to the axis 38.

A layer 44 non-metallic material is positioned between one of the end walls 32, 34 and one of the adjacent side walls 40, 42. In the preferred embodiment shown in FIG. 2, the layer 44 is formed of an abradable sacrificial coating material that is resin-bonded or otherwise permanently affixed to the end wall 32 in the end cap 16. However, the coating material could also be affixed to the end wall 34 or even the side walls 40, 42 of the rotary element 36.

The material for the sacrificial coating layer 44 is a fluoropolymer dry-film lubricant. The material should be capable of withstanding continuous temperatures from approximately −100° Fahrenheit (−73° Celsius) to 400° Fahrenheit (202° Celsius) and surviving up to approximately 450° Fahrenheit (230° Celsius) intermittently. The material has a coefficient of friction between approximately 0.05–0.10, a dielectric strength of approximately 500 V/mil., and a pencil hardness of approximately 4–6 H. The coating material is oleophobic and should be capable of withstanding most solvents, waters, automotive fluids and fuels up to 200° Fahrenheit (93° Celsius). The preferred material is available from Whitford Corporation of West Chester, Pa. under the trade designation XYLAN™ 1421.

Figure 2:
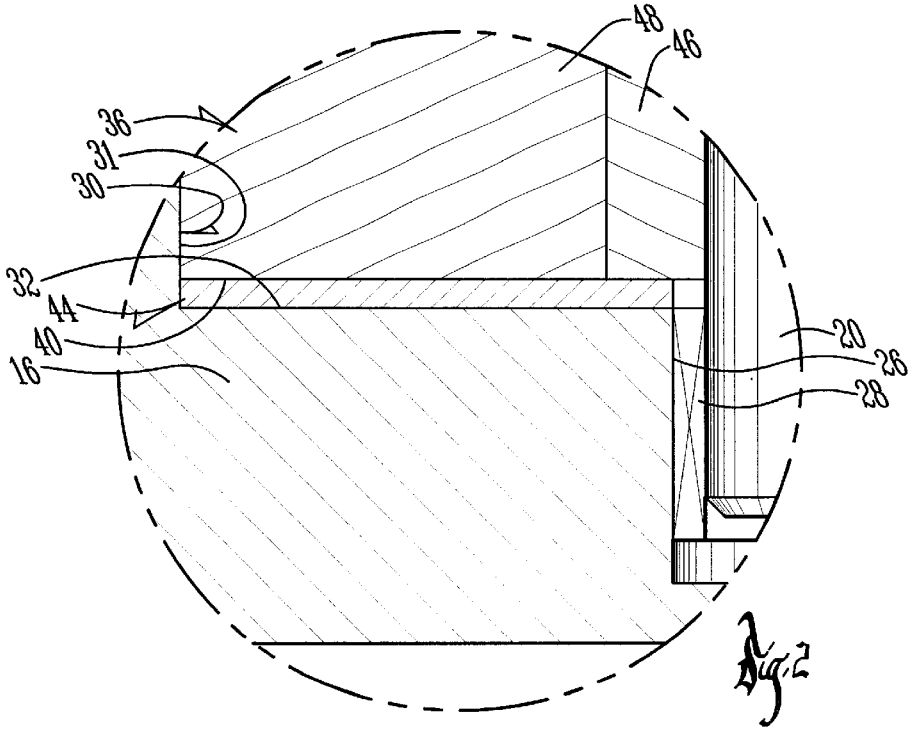
FIG. 2 is an enlarged view of the area designated 2—2 in FIG. 1.

The present invention is applicable to hydraulic pumps or motors having various types of rotary elements 36, including but not limited to gerotors, gears and vanes. In the case of a gerotor type rotary element, a gerotor set is provided. The gerotor set includes an inner gerotor 46 and an outer gerotor 48, as shown in FIGS. 1 and 2.

In use, the coating layer 44 is applied and resin-bonded to the end wall 32 of the end cap 16 as shown in the figures. Preferably, the layer 44 has a uniform initial thickness and covers the entire end wall 32. Then the rotary element 36 or gerotor set 46, 48 is installed in the chamber 30 and drivingly secured to the shaft 20. The main housing body 14 and the end cap 16 are fastened together with the screws 18.

As the assembled unit 10 runs, the shaft 20 and the rotary element 36 rotate. The coating layer 44 is slidably engaged and thereby abraded by the side wall 40 of the rotary element 36. Thus, at least a portion of the coating layer 44 "vanishes" or wears away because of the abrasion. The coating layer 44 is able to take up any manufacturing tolerances between the parts and one can establish a zero or near-zero side clearance. The sacrificial coating 44 will wear-in during dynamic operation and establish the minimum side clearance for proper operation. This will maximize the volumetric operating efficiency of the hydraulic unit.

Thus, it can be seen that the present invention at least satisfies its stated objectives.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the scope of the invention as further defined in the following claims.

What is claimed is:

1. A positive displacement hydraulic unit comprising:

a housing having a chamber formed therein with a circumferential surface bounded by a pair of spaced apart end walls;

a rotary element for displacing fluid rotatably mounted in the chamber of the housing, the rotary element including opposite side walls generally adjacent to and directed toward the end walls of the chamber respectively;

a layer of non-metallic abradable coating material positioned between one of the end walls of the chamber and an adjacent side wall of the rotary element such that at least a portion of said layer vanishes by slidable abrasion caused by rotation of the rotary element;

the rotary element being a gerotor set including an inner gerotor and an outer gerotor.

2. The hydraulic unit of claim 1 wherein the layer of abradable sacrificial coating material is affixed to one of the end walls of the chamber.

3. The hydraulic unit of claim 2 wherein the abradable sacrificial coating material is resin-bonded to one of the end walls of the chamber.

4. The hydraulic unit of claim 2 wherein the housing has a main housing body and an end cap detachably mounted to the main housing body, the end cap including said end wall to which the coating material is affixed.

5. The hydraulic unit of claim 2 wherein the layer of abradable sacrificial coating material covers substantially all of said end wall to which it is affixed.

6. The hydraulic unit of claim 1 wherein the abradable sacrificial coating material is an oleophobic material.

7. The hydraulic unit of claim 1 wherein the abradable sacrificial coating material is a fluoropolymer dry-film lubricant.

8. The hydraulic unit of claim 1 wherein the layer of abradable sacrificial coating material has a substantially uniform initial thickness.

9. A positive displacement hydraulic unit comprising:

a housing having a chamber formed therein with a circumferential surface bounded by a pair of spaced apart end walls;

a shaft rotatably mounted in the housing;

a rotary element for displacing fluid secured to the shaft for rotation therewith within the chamber of the housing, the rotary element including opposite side walls directed toward the end walls of the chamber respectively;

a layer of non-metallic abradable sacrificial coating material having two opposing surfaces, a first surface affixed to one end of the end walls and a second surface slidably and abradably engaged by one of the side walls of the rotary element;

the rotary element being a gerotor set including an inner gerotor and an outer gerotor.

10. The hydraulic unit of claim 9 wherein the first surface is affixed by a resin-bonding to one of the end walls.

11. The hydraulic unit of claim 9 wherein the coating material is a fluoropolymer dry-film lubricant.

* * * * *